US008238809B2

(12) United States Patent
Sato et al.

(10) Patent No.: US 8,238,809 B2
(45) Date of Patent: Aug. 7, 2012

(54) IMAGE FORMING SYSTEM, IMAGE FORMING APPARATUS, AND CONTROL METHOD THEREOF

(75) Inventors: Mitsuhiko Sato, Kashiwa (JP); Ichiro Sasaki, Toride (JP); Hidenori Sunada, Toride (JP); Manabu Yamauchi, Kashiwa (JP); Naoto Watanabe, Abiko (JP); Takayuki Fujii, Tokyo (JP); Toshiyuki Miyake, Toride (JP); Takashi Yokoya, Kashiwa (JP); Naohisa Nagata, Moriya (JP)

(73) Assignee: Canon Kabushiki Kaisha (JP)

( * ) Notice: Subject to any disclaimer, the term of this patent is extended or adjusted under 35 U.S.C. 154(b) by 254 days.

(21) Appl. No.: 11/860,954

(22) Filed: Sep. 25, 2007

(65) Prior Publication Data

US 2008/0075475 A1 Mar. 27, 2008

(30) Foreign Application Priority Data

Sep. 27, 2006 (JP) ..... 2006-263258

(51) Int. Cl.
*G03G 15/00* (2006.01)

(52) U.S. Cl. ..... 399/407; 399/16; 399/82; 271/298

(58) Field of Classification Search ..... 399/8, 9, 399/23, 82, 388, 391, 407, 16; 271/3.14, 271/9.01, 9.05, 298
See application file for complete search history.

(56) References Cited

U.S. PATENT DOCUMENTS 5,248,136 A * 9/1993 Hamanaka ..... 270/58.14
5,999,758 A 12/1999 Rai et al.
6,072,585 A 6/2000 Dutton et al.
6,594,027 B1 7/2003 Guillemin et al.
2004/0175200 A1 9/2004 Namura
2005/0025543 A1* 2/2005 Watanabe et al. ..... 399/391
2005/0082735 A1* 4/2005 Nakamura et al. ..... 271/1
2006/0083534 A1 4/2006 Ogura

FOREIGN PATENT DOCUMENTS

JP 2005-195929 A 7/2005
JP 2006-035751 A 2/2006
JP 2006-168967 A 6/2006

OTHER PUBLICATIONS

Extended Search Report, dated Oct. 7, 2008, issued in corresponding EP application No. 07117347.0-1240/1905607.
Office Action issued in corresponding Japanese Patent Application No. 2006-263258 dated May 13, 2011.

* cited by examiner

*Primary Examiner* — Walter L Lindsay, Jr.
*Assistant Examiner* — Benjamin Schmitt
(74) *Attorney, Agent, or Firm* — Rossi, Kimms & McDowell LLP

(57) ABSTRACT

An image forming system is provided that alleviates throughput reductions and enables reductions in power consumption and lower noise. The image forming system includes an image forming apparatus that forms an image on a recording material and a plurality of sheet-conveying devices that convey the recording material. Furthermore, the image forming apparatus includes a storage unit configured to store connecting orders of the plurality of sheet-conveying devices and a determination unit configured to determine which of the sheet-conveying devices should be given notification by an operation start request or an operation end request according to designation information that designates the sheet-conveying device to which the recording material is conveyed and the connecting orders for the plurality of sheet-conveying devices. Further still, the image forming apparatus includes a transmitting unit configured to transmit an operation start request or an operation end request to each determined sheet-conveying device.

7 Claims, 20 Drawing Sheets

FIG. 5A

| DISCHARGE DESTINATION ID | TRAY | DISCHARGING PATH |
|---|---|---|
| 1 | SAMPLE TRAY OF STACKER 5 | 1 |
| 2 | STACKING TRAY OF STACKER 5 | 1 |
| 3 | SAMPLE TRAY OF STACKER 6 | 1→2 |
| 4 | STACKING TRAY OF STACKER 6 | 1→2 |
| 5 | SAMPLE TRAY OF STACKER 52 | 1→2→3 |
| 6 | STACKING TRAY OF STACKER 52 | 1→2→3 |
| 7 | DISCHARGE TRAY OF FINISHER 7 | 1→2→3→4 |
| 8 | CASE BINDING TRAY OF FINISHER 7 | 1→2→3→4 |

FIG. 5B

| DEVICE ID | POST-PROCESS DEVICE |
|---|---|
| 1 | STACKER 5 |
| 2 | STACKER 6 |
| 3 | STACKER 52 |
| 4 | FINISHER 7 |

FIG. 6

600

| DEVICE ID | STATUS | queue (QUEUE) | | | | | | | |
|---|---|---|---|---|---|---|---|---|---|
| 1 | DMT | | | | | | | | |
| 2 | DMT | | | | | | | | |
| 3 | DMT | | | | | | | | |
| 4 | DMT | | | | | | | | |

FIG. 8

| PAGE ID | DISCHARGE DESTINATION ID | DEVICE ID | FINAL SHEET | OPERATION MODE |
|---|---|---|---|---|
| 1 | 7 | 4 | × | |
| 2 | 7 | 4 | × | |
| 3 | 7 | 4 | × | |
| 4 | 1 | 1 | × | INTERRUPT |
| 5 | 1 | 1 | ○ | INTERRUPT |
| 6 | 7 | 4 | × | |
| 7 | 7 | 4 | ○ | |
| 8 | 5 | 3 | × | |
| 9 | 5 | 3 | ○ | |
| 10 | 4 | 2 | ○ | |

FIG. 10A

| DEVICE ID | STATUS | queue | | | | | | | |
|---|---|---|---|---|---|---|---|---|---|
| 1 | DMT | | | | | | | | |
| 2 | DMT | | | | | | | | |
| 3 | DMT | | | | | | | | |
| 4 | DMT | | | | | | | | |

| DEVICE ID | STATUS | queue | | | | | | | |
|---|---|---|---|---|---|---|---|---|---|
| 1 | ACT | 1 | | | | | | | |
| 2 | ACT | 1 | | | | | | | |
| 3 | ACT | 1 | | | | | | | |
| 4 | ACT | 1 | | | | | | | |

FIG. 10B

| DEVICE ID | STATUS | queue | | | | | | | | | |
|---|---|---|---|---|---|---|---|---|---|---|---|
| 1 | ACT | 1 | 2 | | | | | | | | |
| 2 | ACT | 1 | 2 | | | | | | | | |
| 3 | ACT | 1 | 2 | | | | | | | | |
| 4 | ACT | 1 | 2 | | | | | | | | |

FIG. 10C

| DEVICE ID | STATUS | queue | | | | | | | |
|---|---|---|---|---|---|---|---|---|---|
| 1 | ACT | 1 | 2 | 3 | | | | | |
| 2 | ACT | 1 | 2 | 3 | | | | | |
| 3 | ACT | 1 | 2 | 3 | | | | | |
| 4 | ACT | 1 | 2 | 3 | | | | | |

FIG. 10D

| DEVICE ID | STATUS | queue | | | | | | | | | |
|---|---|---|---|---|---|---|---|---|---|---|---|
| 1 | ACT | 1 | 2 | 3 | 4 | | | | | | |
| 2 | ACT | 1 | 2 | 3 | | | | | | | |
| 3 | ACT | 1 | 2 | 3 | | | | | | | |
| 4 | ACT | 1 | 2 | 3 | | | | | | | |

FIG. 10E

| DEVICE ID | STATUS | queue | | | | | | | | |
|---|---|---|---|---|---|---|---|---|---|---|
| | | 1 | 2 | 3 | 4 | 5 | | | | |
| 1 | ACT | | | | | | | | | |
| 2 | ACT | | | | | | | | | |
| 3 | ACT | | | | | | | | | |
| 4 | ACT | | | | | | | | | |

FIG. 10F

| DEVICE ID | STATUS | queue | | | | | | | | | |
|---|---|---|---|---|---|---|---|---|---|---|---|
| 1 | ACT | 1 | 2 | 3 | 4 | 5 | 6 | | | | |
| 2 | ACT | 1 | 2 | 3 | 6 | | | | | | |
| 3 | ACT | 1 | 2 | 3 | 6 | | | | | | |
| 4 | ACT | 1 | 2 | 3 | 6 | | | | | | |

FIG. 10G

| DEVICE ID | STATUS | queue | | | | | | | | | |
|---|---|---|---|---|---|---|---|---|---|---|---|
| 1 | ACT | 1 | 2 | 3 | 4 | 5 | 6 | 7 | | | |
| 2 | ACT | 1 | 2 | 3 | 6 | 7 | | | | | |
| 3 | ACT | 1 | 2 | 3 | 6 | 7 | | | | | |
| 4 | DMT | 1 | 2 | 3 | 6 | 7 | | | | | |

FIG. 10H

| DEVICE ID | STATUS | queue | | | | | | | | | |
|---|---|---|---|---|---|---|---|---|---|---|---|
| 1 | ACT | 1 | 2 | 3 | 4 | 5 | 6 | 7 | 8 | | |
| 2 | ACT | 1 | 2 | 3 | 6 | 7 | 8 | | | | |
| 3 | ACT | 1 | 2 | 3 | 6 | 7 | 8 | | | | |
| 4 | DMT | 1 | 2 | 3 | 6 | 7 | | | | | |

FIG. 10I

| DEVICE ID | STATUS | queue | | | | | | | | | |
|---|---|---|---|---|---|---|---|---|---|---|---|
| 1 | ACT | 1 | 2 | 3 | 4 | 5 | 6 | 7 | 8 | 9 | |
| 2 | ACT | 1 | 2 | 3 | 6 | 7 | 8 | 9 | | | |
| 3 | ACT | 1 | 2 | 3 | 6 | 7 | 8 | 9 | | | |
| 4 | DMT | 1 | 2 | 3 | 6 | 7 | | | | | |

FIG. 10J

| DEVICE ID | STATUS | queue | | | | | | | | | |
|---|---|---|---|---|---|---|---|---|---|---|---|
| | | 1 | 2 | 3 | 4 | 5 | 6 | 7 | 8 | 9 | 10 |
| 1 | DMT | 1 | 2 | 3 | 4 | 5 | 6 | 7 | 8 | 9 | 10 |
| 2 | DMT | 1 | 2 | 3 | 6 | 7 | 8 | 9 | 10 | | |
| 3 | DMT | 1 | 2 | 3 | 6 | 7 | 8 | 9 | | | |
| 4 | DMT | 1 | 2 | 3 | 6 | 7 | | | | | |

IMAGE FORMING SYSTEM, IMAGE FORMING APPARATUS, AND CONTROL METHOD THEREOF

BACKGROUND OF THE INVENTION

1. Field of the Invention

The present invention relates to image forming systems that include sheet-conveying devices, and image forming apparatuses and control methods thereof.

2. Description of the Related Art

In recent years the image quality of electrophotographic and inkjet method image forming apparatuses has begun to approach the image quality of offset printing and therefore many such image forming apparatuses are introduced even in the field of commercial printing.

On the other hand, attention is being given to on-demand printing in the field of commercial printing. On-demand printing refers to print processing that is executed based on print data sent from a customer via a telecommunications line. On-demand printing can also flexibly support demand for diversified, small quantity printing and therefore is also suited to printing of documents such as manuals and individually targeted pamphlets, for example. Furthermore, on-demand printing has many advantages such as major reductions in printed stock, major reductions in labor and time due to being able to go online from receiving data until completion of binding, and the ease of data transfers.

In regard thereof, a plurality of large capacity sheet-feeding units are connected in image forming systems used in on-demand printing in order to support a wide variety of recording materials. Furthermore, a plurality of post-process devices are necessary to achieve post-processing such as alignment, sorting, z-folding, inserter processing, stapling, punch hole opening, and bookbinding processing.

However, starting and stopping all of the plurality of sheet-feeding units and plurality of post-process devices as a group involves consuming wasted energy and increasing noise pollution, and is therefore not preferable.

Conventionally, an invention has been proposed (Japanese Patent Laid-Open No. 2005-195929) in which an individual post-process device independently stops operation when a determination is made in response to paper destination information that a predetermined number or more of sheets is not to be transported to the device.

However, some post-process devices among a plurality of post-process devices having stopped their operation may require a preparatory operation for restarting. Accordingly, there is a risk that throughput of the image forming system will be reduced undesirably when individual post-process devices stop operation by themselves. Furthermore, in the image forming system of Japanese Patent Laid-Open No. 2005-195929, each post-process device always waits for the predetermined number of sheets of paper to arrive at the device itself before stopping. Hence, throughput is reduced undesirably when there is no necessity to wait for the arrival of the predetermined number of sheets of paper. It should be noted that Japanese Patent Laid-Open No. 2005-195929 gives attention to post-process devices, but does not give attention to sheet-feeding units.

SUMMARY OF THE INVENTION

Accordingly, the present invention provides an image forming apparatus connectable to a plurality of sheet-conveying devices that convey a recording material. The image forming apparatus comprising:

a storage unit configured to store connecting orders of the plurality of sheet-conveying devices, a determination unit configured to determine which of the sheet-conveying devices should be given notification by an operation start request or an operation end request according to designation information that designates the sheet-conveying device to which the recording material is conveyed and the connecting orders for the plurality of sheet-conveying devices, and a transmitting unit configured to transmit an operation start request or an operation end request to each determined sheet-conveying device.

The present invention further provides an image forming system comprising the image forming apparatus that forms an image on a recording material, and a plurality of sheet-conveying devices that convey the recording material.

The present invention further provides a control method of the image forming apparatus.

Further features of the present invention will become apparent from the following description of exemplary embodiments (with reference to the attached drawings).

BRIEF DESCRIPTION OF THE DRAWINGS

FIG. 5A shows an example of a discharging path list according to an embodiment of the present invention.

FIG. 5B shows an example of a device ID management list according to an embodiment of the present invention.

FIG. 6 shows an example of a status list for managing statuses of post-process devices according to an embodiment of the present invention.

FIG. 8 shows an example of a print job.

FIGS. 10A through 10J show status lists corresponding to the events.

DESCRIPTION OF THE EMBODIMENTS

An embodiment of the present invention is described below. Of course, each of the separate embodiments to be described below will be useful in understanding various concepts such as generic concepts, mid-level concepts, and subordinate concepts of the present invention. Furthermore, the technical scope of the present invention is to be established by the claims and not limited by the following separate embodiments.

Figure 1:
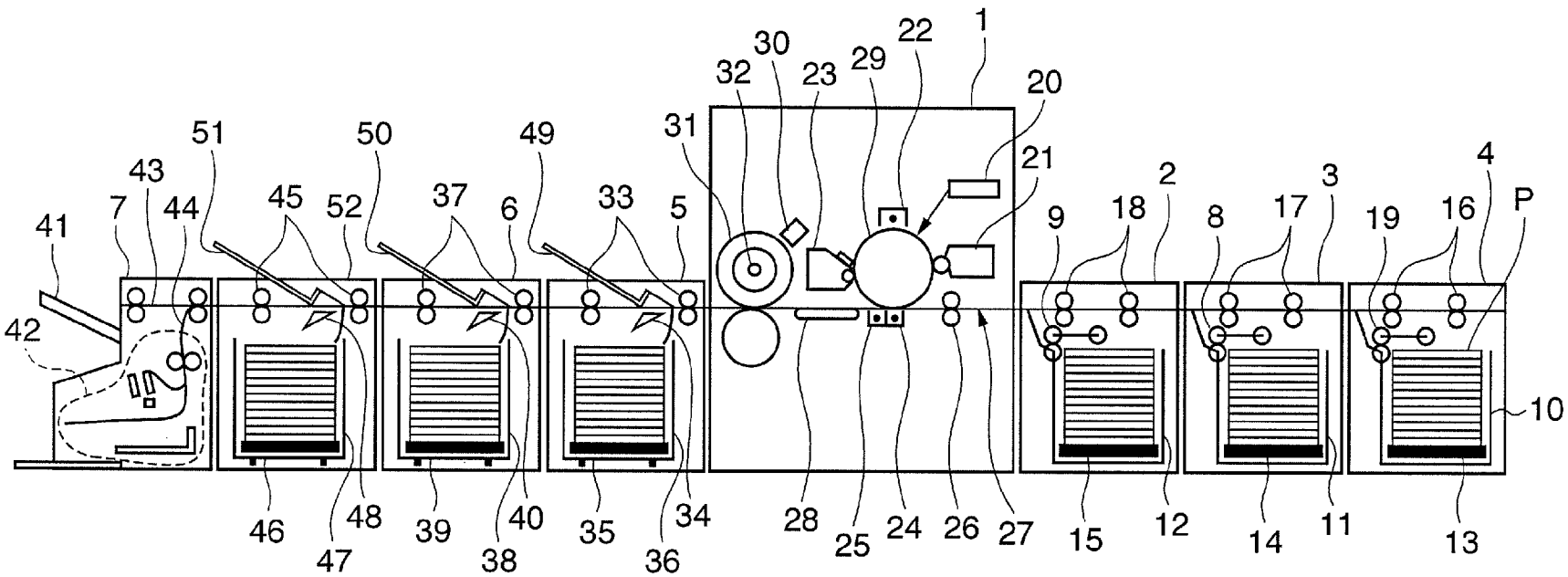
FIG. 1 is an illustrative cross-sectional view of an image forming system according to an embodiment of the present invention.

FIG. 1 is an illustrative cross-sectional view of an image forming system according to the present embodiment. Numeral 1 indicates an image forming apparatus. Numerals 2, 3, and 4 indicate sheet-feeding units that store a recording material P. It should be noted that the recording material may also be referred to as recording media, paper, sheets, transfer material, and transfer paper. Numerals 5, 6, and 52 indicate stackers that stack the recording material. Numeral 7 indicates a finisher. It should be noted that the stackers 5, 6, and 52 and the finisher 7 are examples of so-called post-process devices. Both the post-process device and the sheet-feeding unit are examples of a sheet-conveying device that conveys the recording material.

For example, the image forming apparatus 1 is provided with structural elements such as the following. A photosensitive drum 29 carries latent images and images made visible by toner. A primary charger 22 uniformly charges the photosensitive drum. An exposure device 20 irradiates image data, which has been converted into light signals, onto the photosensitive drum 29. A developing device 21 uses toner to convert a latent image formed on the photosensitive drum 29 into a visible image. A transfer charger 24 transfers the toner image formed on the photosensitive drum 29 onto the recording material. A separation charger 25 applies a high voltage to separate the recording material from the photosensitive drum. A cleaner 23 recovers toner that has not transferred and remains on the photosensitive drum 29.

The sheet-feeding units 2, 3, and 4 are provided respectively with the following structural elements. Storage cabinets 12, 11, and 10 are for stacking and storing recording material. Paper feed rollers 9, 8, and 19 separate and feed stacked recording material sheet by sheet. Lifters 15, 14, and 13 adjust a sheet-surface height of the recording material to an appropriate position so that the paper feed rollers 9, 8, and 19 can feed paper. Transport rollers 18, 17, and 16 transport recording material from the storage cabinets or from preceding (upstream) sheet-feeding units.

Incidentally, the sheet-feeding units 2, 3, and 4 respectively have blowers (not shown) that blow air that has been warmed by heaters (not shown) into the storage cabinets 12, 11, and 10. Thus, the humidity inside the storage cabinets 12, 11, and 10 is regulated. It should be noted that humidity regulation control varies depending on the material of the recording material. For example, it is not necessary to perform humidity regulation control for plain paper having a grammage in an approximate range of 64 $g/m^2$ to 105 $g/m^2$. On the other hand, humidity regulation is necessary for thick papers having a grammage of 105 $g/m^2$ or more. Furthermore, recording material cannot be transported from the sheet-feeding units 2, 3, and 4 in which the temperature targeted by the heater has not been reached. Hence, the time from powering on or from a command to commence operation until transport operations actually commence changes depending on parameters of the material or the like of the recording material stacked in the sheet-feeding units 2, 3, and 4.

The arrival of the recording material fed from the sheet-feeding units 2, 3, and 4 to the image forming apparatus 1 is detected by a recording material detection sensor 27. Skew is corrected by the recording material hitting against registration rollers 26. Further still, the recording material is transported to the transfer charger 24 where the toner image is transferred. Thereafter, the recording material is transported by a transport belt 28 in a direction toward fixing rollers 31. The fixing rollers 31 are constituted by a pair of rollers. A halogen heater 32 is built into an upper side roller of the pair of fixing rollers. Furthermore, a thermistor 30 for detecting the temperature of the fixing rollers is arranged near the upper side roller. The temperature of the fixing roller 31 is maintained at approximately 180° C. by the halogen heater 32. Recording material that has passed through the fixing rollers 31 is transported to the stacker 5, which is directly connected to the image forming apparatus 1 and is an example of the post-process devices.

The stackers 5, 6, and 52 are provided respectively with structural elements such as the following. Storage cabinets 36, 38, and 47 are for storing recording material. Stacking trays 35, 39, and 46 are for stacking the recording material of the storage cabinets 36, 38, and 47. Transport rollers 33, 37, and 45 transport the recording material to sample trays, storage cabinets, or subsequent post-process devices. Sample trays 49, 50, and 51 are for stacking a small number of sheets of recording material such as recording material printed as samples. Flappers 34, 40, and 48 are for switching the transport paths of the recording material. There are three paths pertaining to the respective stackers as transport paths, a path for stacking to the storage cabinet, a path for transporting recording material to downstream (subsequent) post-process devices, and a path for stacking the recording material to the sample tray.

The finisher 7 is provided with a discharge tray 41 for stacking the recording material. The recording material is stacked onto the discharge tray 41 via a transport path 43. On the other hand, a portion surrounded by a dotted line in the cross-sectional view of the finisher 7 is a case binding unit 42. The case binding unit 42 is for performing case binding on recording material transported via a transport path 44.

Figure 2:
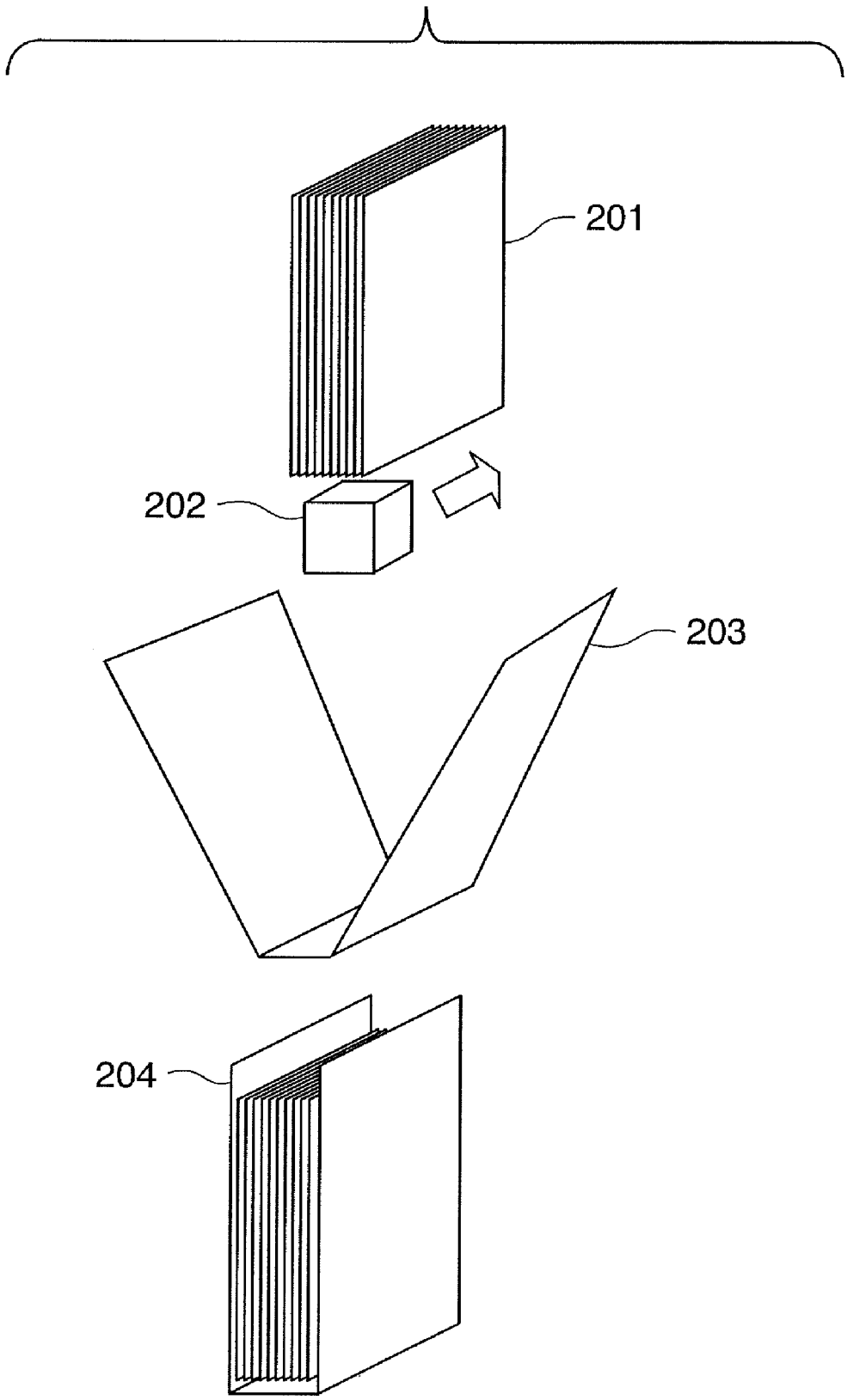
FIG. 2 is a diagram for describing case binding.

FIG. 2 is a diagram for describing case binding. For example, an adhesion unit 202 carries out adhesion on a spine of a sheaf 201 constituted by a plurality of sheets of A4 size recording material. Then a sheaf 204 is formed by wrapping the adhered sheaf 201 with an A3 size cover sheet 203. The sheaf 204 is cut to a predetermined size by a cutting unit not shown in FIG. 2. It should be noted that the glue for attaching the cover sheet 203 to the sheaf 201 is generally solid at room temperature. Accordingly, it is necessary to heat the glue using a heater or the like for use in the adhesion operation, and ordinarily the heating requires several minutes. Thus, after heating of the heater has been stopped, a waiting time is caused to a certain extent to once again heat the adhesion unit 202 to the desired temperature.

Figure 3:
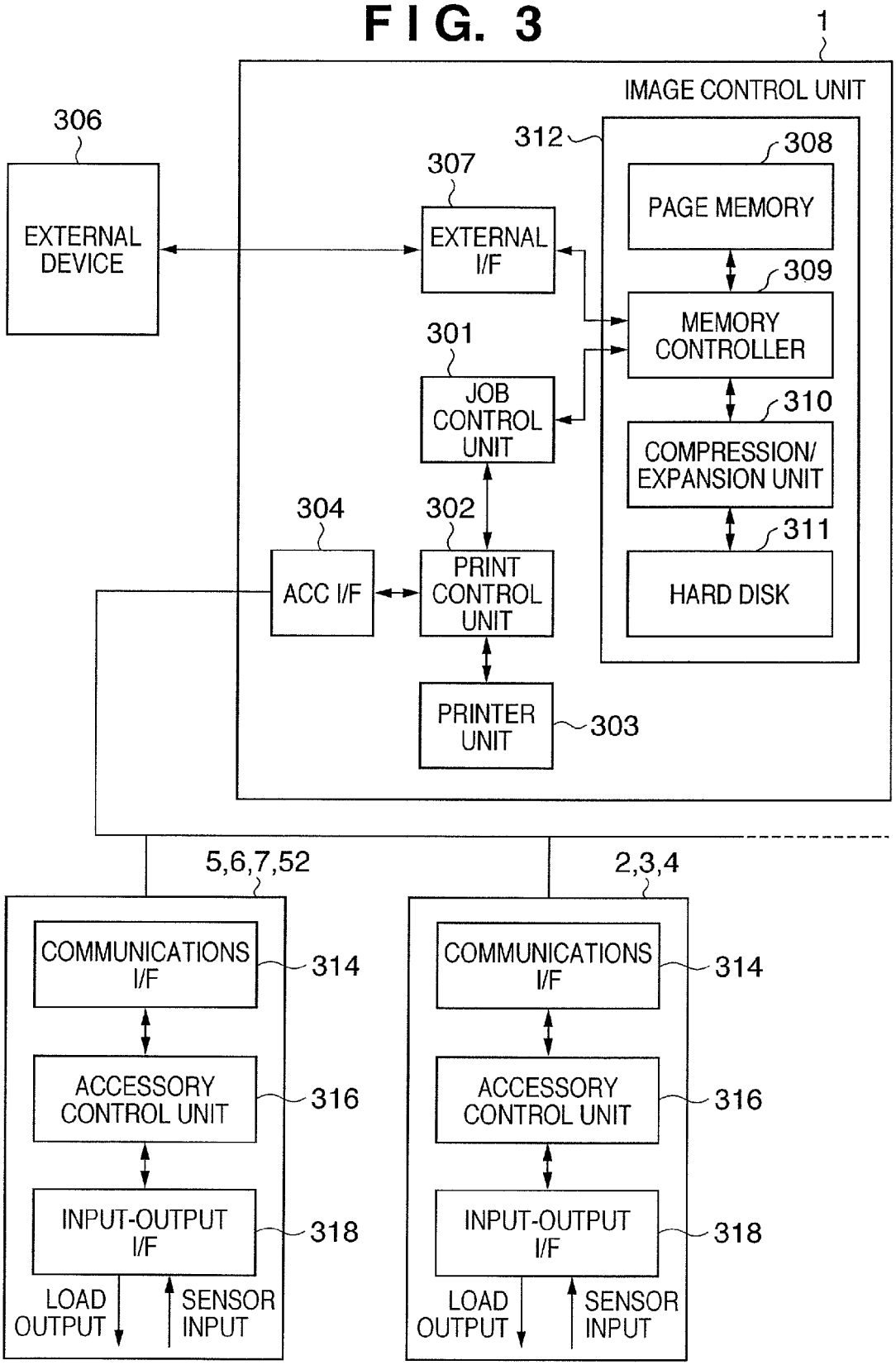
FIG. 3 is a block diagram showing an example of a control unit according to an embodiment of the present invention.

FIG. 3 is a block diagram showing an example of a control unit according to the present embodiment. Numeral 306 indicates an external device such as a personal computer (PC) or an image reading device that sends print jobs or the like to the image forming apparatus 1. A print job includes image data and print data. Generally print data includes information such as designation information that designates a post-process device to/from/by which the recording material is discharged and designation information that designates a sheet-feeding unit for supplying the recording material.

Print jobs sent from the external device 306 are received at an external interface 307 of the image forming apparatus 1. Print jobs received at the external interface 307 are sent to a memory controller 309. The memory controller 309 extracts image data from the print jobs and sends these to a compression and decompression unit 310. The image data is compressed, and therefore the compression and decompression unit 310 converts the image data to internal data. Image data that has been converted to internal data is stored on a hard disk 311. The hard disk 311 can be also be configured using another large capacity storage unit. It should be noted that the hard disk 311 stores connecting orders (attaching orders) for the plurality of post-process devices and connecting orders for the plurality of sheet-feeding units.

On the other hand, the memory controller 309 extracts print data contained in the print jobs and sends the print data thus extracted to a job control unit 301. Upon receiving the print data, the job control unit 301 sends an operation start request to a print control unit 302 so as to start a print operation. Upon receiving the operation start request, the print control unit 302 sends the operation start request to a printer unit 303 and sends the operation start request via an accessory (ACC)

interface 304 to the sheet-feeding unit and the post-process device designated in the print data. That is, the accessory interface 304 functions as a transmitting unit that sends notifications such as operation start requests. It should be noted that accessory is a general term for devices connected to the image forming apparatus 1, including sheet-feeding units and post-process devices.

At such time, the print control unit 302 functions as a determination unit that determines which post-process device should be notified of the operation start request according to the designation information that designates the post-process device to which recording material is discharged and the connecting orders for the plurality of post-process devices. Furthermore, the print control unit 302 functions as a determination unit that determines which sheet-feeding units should be given notification by an operation start request or an operation end request according to the designation information that designates the sheet-feeding unit for feeding the recording material and the connecting orders for the plurality of sheet-feeding units.

It should be noted that sheet-feeding units and the post-process devices do not necessarily fulfill the same functions but their electrical control units may employ substantially the same configuration. Accordingly, the control units of the sheet-feeding units and the post-process devices here employ the same configuration in order to simplify description.

A communications interface 314 receives commands such as operation start requests sent from the image forming apparatus 1 and sends certain information to the image forming apparatus 1. An input-output interface 318 is a unit for driving a load of a motor and the like and receiving sensor signals. An accessory control unit 316 carries out communications with the image forming apparatus 1 and other neighboring devices. The accessory control units 316 installed in the sheet-feeding units for example control the transport of the recording material and control the paper feeding. Furthermore, the accessory control units 316 installed in the post-process devices for example control the transport of the recording material and control the post-processing.

A printer unit 303 of the image forming apparatus 1 is a unit that forms images on the recording material in the image forming apparatus 1. When various operation preparations are finished in the printer unit 303 as well as in the sheet-feeding units and the post-process devices involved in the print job, the job control unit 301 requests the memory controller 309 to output the image data page by page. The memory controller 309 reads out from the hard disk 311 the image data that has been converted to internal data. The compression and decompression unit 310 decompresses the image data that has been read out into bitmap data printable by the image forming apparatus 1 and stores the result in a page memory 308. The job control unit 301 sends the bitmap data sent from the memory controller 309 to the printer unit 303 via the print control unit 302. The print control unit 302 instructs the printer unit 303 to execute image forming. Further still, the print control unit 302 instructs the designated sheet-feeding unit to commence transport of the recording material. Furthermore, the print control unit 302 sends information about the recording material via the accessory interface 304 to each of the post-process devices positioned on the transport path of the recording material.

When the print job is finished, the job control unit 301 instructs the print control unit 302 to finish operation. The print control unit 302 sends operation end requests to the sheet-feeding units and post-process devices as required via the accessory interface 304. That is, the accessory interface 304 functions as a transmitting unit that sends notifications such as operation end requests.

At such time, the print control unit 302 functions as a determination unit that determines which post-process device should be notified of the operation end request according to the designation information that designates the post-process device to which recording material is discharged and the connecting orders for the plurality of post-process devices. Similarly, the print control unit 302 functions as a determination unit that determines which sheet-feeding unit should be notified of the operation end request according to the designation information that designates the sheet-feeding unit for feeding recording material and the connecting orders for the plurality of sheet-feeding units. Furthermore, the print control unit 302 gives instruction to the printer unit 303 to finish operation.

It should be noted that while the print job is being executed by the print control unit 302, sometimes a next print job will arrive from the external device 306. In such a circumstance, the job control unit 301 stores the image data to the hard disk 311 via the memory controller 309 and stores the print data in a RAM (not shown in the diagrams) provided in the job control unit 301. It should be noted that the print data may also be stored on the hard disk 311. Thus, the RAM and the hard disk 311 function as storage units. And when the previous print job is finished, the job control unit 301 executes the next print job in order.

Figure 4:
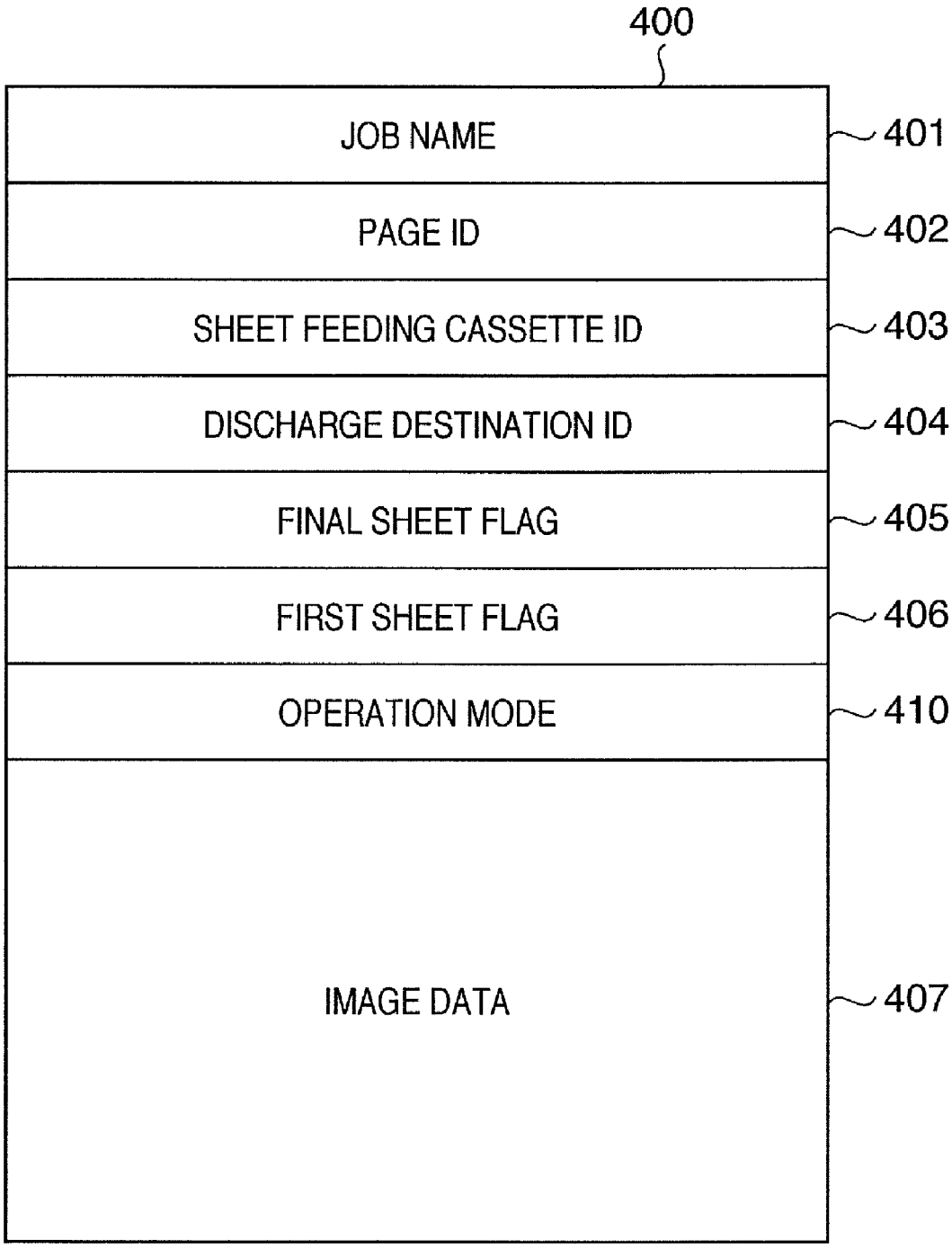
FIG. 4 shows an example of a data structure of a print job according to an embodiment of the present invention.

FIG. 4 shows an example of a data structure of a print job according to an embodiment of the present invention. In a print job, data is allotted on a page basis. Accordingly, a print job is constituted by a number of sets of page data corresponding to the number of pages to be printed. For example, a print job for printing three pages has three sets of page data. The structure of any particular set of page data is the same, and therefore, page data 400 is described as an example.

A job name region 401 is provided at a forefront of the page data 400 for storing a job name. A job name is identifying information (ID) or the like for distinguishing a print job from other print jobs for example. A specific page ID that is distinguishable from other pages is stored in a page ID region 402. A sheet feeding cassette ID, which is an example of designation information for designating a sheet-feeding unit for feeding the recording material, is stored in a sheet feeding cassette ID region 403. A discharge destination ID, which is an example of designation information for designating a post-process device from which the recording material is discharged, is stored in a discharge destination ID region 404. A final sheet flag 405 stores information indicating whether or not the page pertaining to this set of print data is the final page of the print job. A first sheet flag 406 stores information indicating whether or not the page pertaining to the present set of print data is the first page of the print job. An operation mode region 410 stores operation mode information indicating an operation mode to be applied to the print job. Examples of operation modes include ordinary operation, an operation (interrupt operation) in which ordinary operation is interrupted and a job having a higher priority order for execution is executed, and an operation (proof print) in which only a portion of a same job is output having its discharge destination diverted to a sample tray. It should be noted that except for image data 407, the data in the page data 400 corresponds to the print data.

FIG. 5A shows one example of a discharging path list according to an embodiment of the present invention. According to the present embodiment, there are eight trays as discharge destinations for the recording material. Accordingly, the discharge destination IDs range from 1 to 8. Specifically, the discharge destination ID of the sample tray 49 of the stacker 5 arranged next to the image forming apparatus 1 is 1. The discharge destination ID of the storage cabinet 36 of the stacker 5 is 2. The discharge destination ID of the sample tray 50 of the stacker 6 is 3. The discharge destination ID of the storage cabinet 38 of the stacker 6 is 4. The discharge destination ID of the sample tray 51 of the stacker 52 is 5. The discharge destination ID of the storage cabinet 47 of the stacker 52 is 6. The discharge destination ID of the discharge tray 41 of the finisher 7 is 7. The discharge destination ID of a case binding tray of the finisher 7 is 8.

Further still, when the discharge destination ID is 1 or 2, the recording material is discharged from the image forming apparatus 1 to the stacker 5. When the discharge destination ID is 3 or 4, the recording material is transported to the stacker 6 via the stacker 5 and discharged to the tray corresponding to the discharge destination ID. When the discharge destination ID is 5 or 6, the recording material is transported to the stacker 52 via the stacker 5 and the stacker 6, then discharged to the tray corresponding to the discharge destination ID. When the discharge destination ID is 7 or 8, the recording material is transported to the finisher 7 via the stacker 5, the stacker 6, and the stacker 52, then discharged to the tray corresponding to the discharge destination ID. It should be noted that the numerals listed in the discharging path column of the discharging path list are device IDs for identifying the post-process devices. Thus, the connecting orders for the plurality of post-process devices are managed as discharging paths. It should be noted that data or lists for managing the connecting orders relating to the sheet-feeding units may also be stored on the hard disk 311 or the like.

FIG. 5B shows an example of a device ID management list according to an embodiment of the present invention. In FIG. 5B, the device ID of the stacker 5 is 1. The device ID of the stacker 6 is 2. The device ID of the stacker 52 is 3. The device ID of the finisher 7 is 4. It should be noted that the discharging paths are defined using device IDs as is evident in FIG. 5A and FIG. 5B.

It should be noted that the device ID management list and the discharging path list are for example created by the print control unit 302 performing communication with each of the post-process devices and each of the sheet-feeding units when the image forming apparatus 1 is activated.

It should also be noted that a relationship between the discharge destination ID and the discharging path is not contained in the data structure of the print job that was described using FIG. 4. Accordingly, it is necessary to store these relationships in advance on the hard disk or the like of the image forming apparatus 1. Thus, when a plurality of post-process devices are connected to the image forming apparatus, it is necessary for the image forming apparatus 1 to grasp for each sheet to which of the post-process devices the sheet is to be discharged.

FIG. 6 shows an example of a status list for managing statuses of post-process devices according to an embodiment of the present invention. A status list 600 for example is created by the job control unit 301 and is stored on a RAM or the hard disk 311.

Device IDs assigned to the post-process devices are stored in a device ID region. Information indicating an operational state or a non-operational state of each post-process device is stored in a status region. For example, "ACT" is stored in a case of an operational state and "DMT" is stored in a case of a non-operational state. Page IDs (FIG. 4) are stored in a queue region. Upon receiving a print job, the job control unit 301 extracts the page ID and the discharge destination ID from the page data 400 thereof. Further still, the job control unit 301 specifies a discharging path from the discharge destination ID and moreover specifies a device ID positioned at the end of the discharging path. Through the print control unit and the accessory interface 304, the job control unit 301 obtains status information from the post-process device corresponding to the device ID. Finally, the job control unit 301 registers the device ID, the status, and the page ID in the status list 600.

Figure 7:
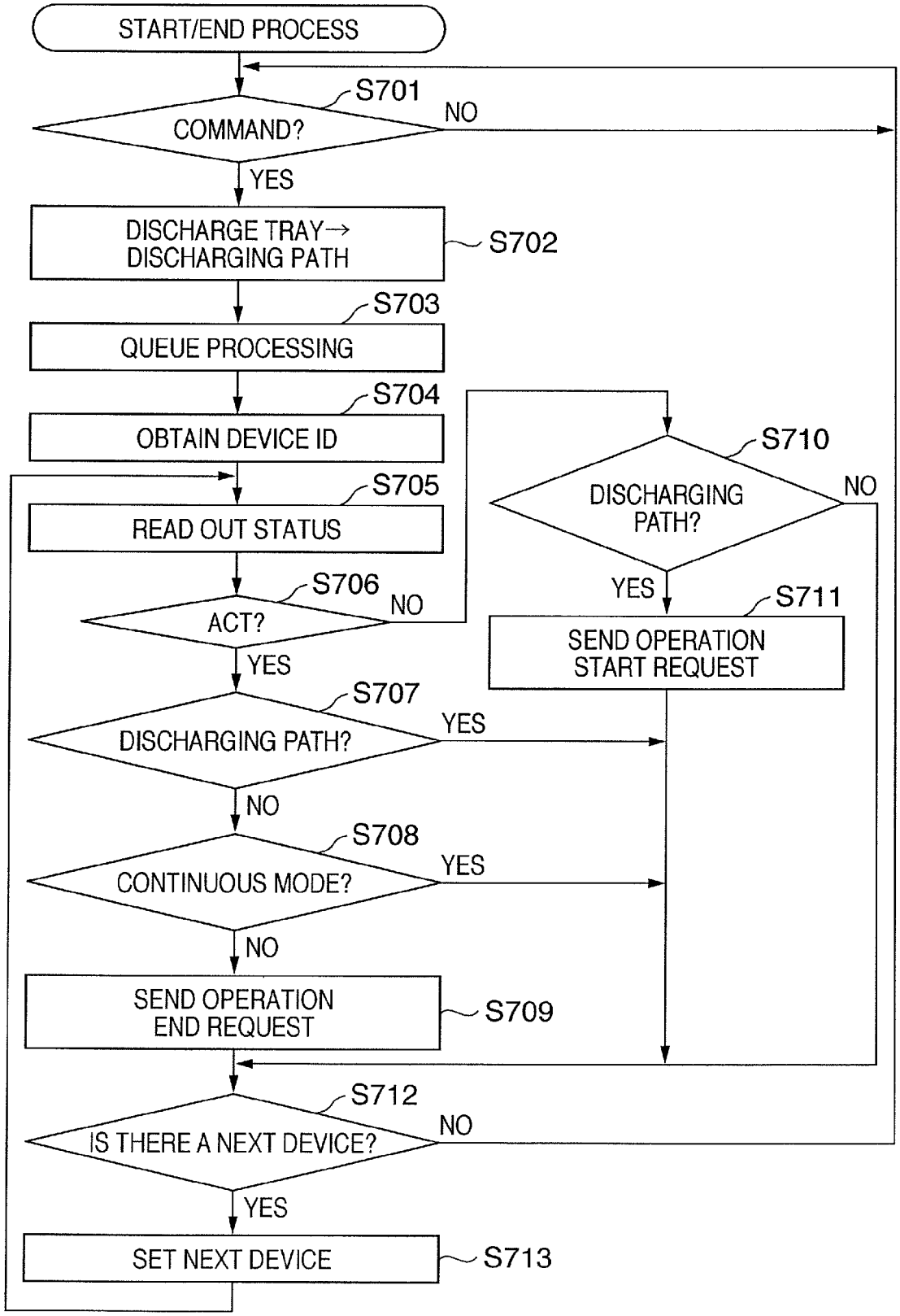
FIG. 7 is a flowchart showing an example of a control method of the image forming apparatus according to an embodiment of the present invention.

FIG. 7 is a flowchart showing an example of a control method of the image forming apparatus according to an embodiment of the present invention. While referencing this flowchart, description is given concerning a manner in which the image forming apparatus 1 controls commencement and completion of operations in the post-process devices.

In step S701, the job control unit 301 waits for the arrival of a command (print job) from the external device 306. When a command arrives, the procedure proceeds to step S702.

In step S702, the job control unit 301 specifies the discharging path. For example, the job control unit 301 reads out the discharge destination ID from the page data 400 of the received print job and compares this against the discharging path list (FIG. 5A) to specify a device ID of the post-process device and the discharging path. The job control unit 301 functions as a discharging path determination unit that determines the discharging path according to the designation information (examples: discharge destination ID and device ID) that designates the post-process device from which the recording material is discharged and the connecting orders for the plurality of post-process devices.

In step S703, the job control unit 301 executes queue processing. For example, the job control unit 301 stores the page ID extracted from the page data into the queue of the status list.

In step S704, the job control unit 301 obtains the device ID. For example, the job control unit 301 references the discharging path list and determines the one or more post-process devices present on the determined discharging path as post-process devices to which operation start requests are to be sent. Further still, the job control unit 301 references the discharging path list and also determines the post-process device that is positioned first on the discharging path. For example, if the discharging path is "1→2→3", the post-process device that is set with the device ID of 1 is the first post-process device. Thus, the job control unit 301 functions as a destination target determination unit that determines the post-process devices to which operation start requests are to be sent.

In step S705, the job control unit 301 reads out from the status list the status of the i-th (where i is a natural number) post-process device present on the discharging path. It should be noted that the status list is created in advance by the job control unit 301. It should also be noted that in step S705 the status may also be obtained directly from the post-process devices.

In step S706, the job control unit 301 determines whether or not the status that has been read out is "ACT". If the status is "ACT", which means "in operation", the procedure proceeds to step S707. On the other hand, if the status is "DMT", which means "not in operation", the procedure proceeds to step S710.

In step S707, the job control unit 301 determines whether or not the post-process device corresponding to the status that has been read out is included on the discharging path. For example, the job control unit 301 reads out the discharge destination ID from the page data of the next page to determine the discharging path based on the discharging path list, then determines whether or not the corresponding post-process device is included on the discharging path. If it is not included on the discharging path, the procedure proceeds to step S708, but if it is included, the procedure proceeds to step S712.

In step S708, the job control unit 301 reads out the operation mode from the received page data and determines whether or not the operation mode that has been read out is a continuous mode. Continuous mode for example is in such cases as when there are remaining pages in an interrupt operation, a proof print, or ordinary operation. For example, the job control unit 301 further examines the next page data to confirm whether or not page currently being processed is the final sheet. If it is the final sheet, then operation will finish, and therefore it is not continuous mode. If it is continuous mode, then the procedure proceeds to step S712. On the other hand, if it is ordinary operation or the like and not continuous mode, the procedure proceeds to step S709.

In step S709, the job control unit 301 sends a command signifying an operation end request to the post-process device involved in the current process. The procedure then proceeds to step S712.

Thus, the job control unit 301 determines the post-process devices that are not present on the determined discharging path as post-process devices to which operation end requests are to be sent and sends the operation end requests. Furthermore, there are times when a post-process device that is not present on the determined discharging path does not satisfy prescribed conditions for operation end dependent on succeeding recording material. Accordingly, the job control unit 301 performs control so that an operation end request is not sent to such a post-process device. That is, undesirable transmitting of an operation end request is avoided by making a determination of continuous mode.

On the other hand, when the post-process device involved in the current process is "DMT", the job control unit 301 determines in step S710 whether or not the "DMT" post-process device is positioned on the discharging path. An undesirable occurrence of jamming of the recording material would result if a post-process device positioned on the discharging path was not operating. Accordingly, to avoid such a circumstance, an operation start request is required to be sent to such a post-process device. It should be noted that a discharging path determination method is as described above. If no "DMT" post-process device is present on the discharging path, then the procedure proceeds to step S712.

On the other hand, if a "DMT" post-process device is present on the discharging path, then the procedure proceeds to step S711. In step S711, the job control unit 301 sends a command signifying an operation start request to the post-process device. Thereafter, the procedure proceeds to step S712.

In step S712, which follows on from S707, S708, S709, S710, and S711 in the flowchart, the job control unit 301 determines whether or not there is a next post-process device involved in processing. If there is a next post-process device, then the procedure proceeds to step S713. In step S713, the job control unit 301 sets the device ID of the post-process device to be involved in processing, determined in step S712, as the device ID of the next post-process device. Thereafter, the procedure returns to step S705, and a processing loop constituted by step S705 to step S713 is executed.

FIG. 8 shows an example of a print job. Description is given concerning updating of the status list when the print job shown in FIG. 8 is sent in from the external device 306. Looking at the page IDs in FIG. 8, it is evident that ten pages are to be printed in the present print job.

Figure 9:
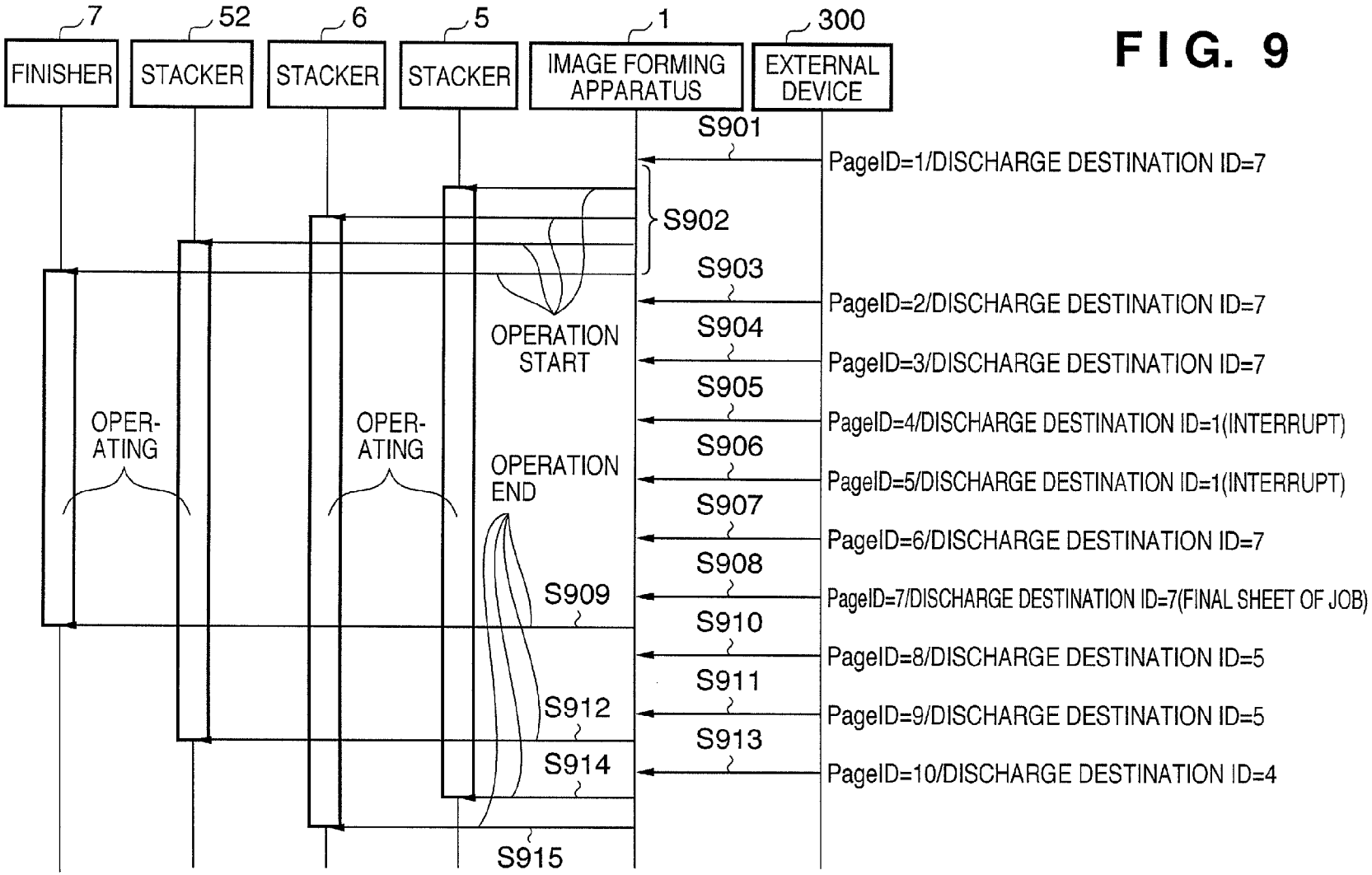
FIG. 9 is an event flowchart showing events in the post-process devices from start to end of the operation, according to an embodiment of the invention.

FIG. 9 is an event flowchart showing events in the post-process devices from start to end of the operation. FIG. 10A through FIG. 10J show status lists corresponding to the events. At first, the state of each post-process device is given as DMT (non-operational state) as shown in FIG. 6.

In step S901, page data concerning recording material whose page ID=1 arrives from the external device 306. Since the discharge destination ID is 7, it is determined from the discharging path list that the discharging path is 1→2→3→4.

In step S902, the image forming apparatus 1 sends a command signifying an "operation start request" to each of the post-process devices positioned on the discharging path. At such time, page ID=1 is registered in the queue of the post-process devices. Furthermore, the status of each of the post-process devices is changed to "ACT". The statuses at the present time are shown in FIG. 10A.

When page data whose page ID=2 arrives from the external device 306 in step S903, the statuses become as shown in FIG. 10B. Further still, when page data whose page ID=3 arrives in step S904, the statuses become as shown in FIG. 10C.

In step S905, page data whose page ID=4 arrives. Since the discharge destination ID of this page data is 1, an "end request" can be sent to the stackers 6 and 52 and the finisher 7. However, the operation mode of the page data is set to "interrupt operation" (FIG. 8) and therefore the image forming apparatus 1 does not send the "end requests". The statuses at this time are as shown in FIG. 10D.

When page data whose discharge destination ID=1 and whose page ID=5 arrives in step S906, the statuses become as shown in FIG. 10E. In step S907, page data whose page ID=6 arrives. It should be noted that the page corresponding to the page ID=6 is a continuation of the pages corresponding to the previous page IDs=1, 2, and 3. According to the present embodiment, since the stackers 6 and 52 and the finisher 7 are in the operational state "ACT", they are capable of transporting recording material immediately. Accordingly, throughput is improved compared to conventional techniques in which it is necessary to send a start request at the present stage. It should be noted that the statuses at the present time are as shown in FIG. 10F.

In step S908, page data whose page ID 7 arrives. According to the page data, the present page is the final sheet (FIG. 8). Accordingly, when recording material corresponding to the page ID=7 is discharged to the tray in the finisher 7, the image forming apparatus 1 sends an "end request" to the finisher 7 in step S909. The statuses at the present time are as shown in FIG. 10G.

The discharge destination IDs of the page data arriving in step S910 whose page ID=8 and the page data arriving in step S911 whose page ID=9 are set to 5 respectively. The discharge destination ID=5 signifies the sample tray of the stacker 52. The statuses at the present time are as shown in FIGS. 10H and 10I. When discharge to the sample tray of the stacker 52 is finished, the image forming apparatus 1 sends an "end request" to the stacker 52 in step S912.

In step S913, page data whose page ID=10 arrives. The discharge destination ID of the page data is 4, which signifies discharge to the stacking tray of the stacker 6. Furthermore, according to the page data, it is evident that the present page is the final sheet (FIG. 8). Accordingly, when discharge of the recording material whose page ID=10 is finished, the image forming apparatus 1 sends an "end request" to the stacker 5 in step S914. Further still, in step S915, the image forming apparatus 1 sends an "end request" to the stacker 6. The statuses at the present time are as shown in FIG. 10J.

As described above, according to the present embodiment, the image forming apparatus determines which devices are to be given notification of operation start requests or operation end requests in response to the connecting orders of the post-process devices and the sheet-feeding units as well as the post-process device that is to be the discharge device and the sheet-feeding unit that actually carries out sheet-feeding. In particular, the image forming apparatus manages each print job and therefore the timings for starting and ending operations of the post-process devices and the sheet-feeding units can be determined more appropriately. Accordingly, compared to conventional techniques in which the starting and ending of operations is determined by the post-process devices independently, the present invention alleviates throughput reductions and enables reductions in power consumption and lower noise.

According to the foregoing embodiment, description was given of a case in which the present invention was applied to post-process devices, but naturally it can also be applied to sheet-feeding units. In such a circumstance, the image forming apparatus 1 can use the hard disk 311 or the like as a storage unit for storing the connecting orders of the plurality of sheet-feeding units. Furthermore, the job control unit 301 functions as a determination unit that determines which sheet-feeding units should be given notification by an operation start request or an operation end request according to the designation information that designates the sheet-feeding unit for feeding the recording material and the connecting orders for the plurality of sheet-feeding units. Furthermore, the accessory interface 304 functions as a transmitting unit that sends operation start requests or operation end requests to the determined sheet-feeding units.

Furthermore, the job control unit 301 may also function as a feeding path determination unit that determines the feeding path from the sheet-feeding unit for feeding the recording material to the image forming apparatus according to the designation information that designates the sheet-feeding unit for feeding the recording material and the connecting orders for the plurality of sheet-feeding units. Further still, the job control unit 301 may also function as a destination target determination unit that determines the one or more sheet-feeding units present on the determined feeding path as sheet-feeding units to which operation start requests are to be sent. The job control unit 301 may also determine the sheet-feeding units that are not present on the determined feeding path as sheet-feeding units to which operation end requests are to be sent.

Further still, the job control unit 301 may also function as a control unit that performs control such that operation end requests are not sent to the sheet-feeding units not present on the determined feeding path that do not satisfy prescribed conditions for operation end dependent on succeeding recording material. It should be noted that the prescribed conditions refer to cases where the succeeding recording material corresponds to the above-described continuous mode. That is, the prescribed conditions are for cases where it is advantageous in terms of throughput, power consumption, or noise to leave the sheet-feeding units operating continuously rather than stopping them.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-263258, filed on Sep. 27, 2006, which hereby incorporated by reference herein in its entirety.

What is claimed is:

1. An image forming apparatus connectable to a plurality of post-processing devices that execute conveyance of a recording material and post-processing on the recording material from the image forming apparatus, at least one of the plurality of the post-processing devices requiring a preparatory operation, the image forming apparatus comprising:

a storage unit configured to store connecting orders of the plurality of post-processing devices, a receiver unit configured to receive job information for a plurality of recording materials to be processed including designation information for designating a post-processing device to which each of the recording materials should be discharged, a determination unit configured to determine which of the post-processing devices should be given notification of an operation start request and determine which of the post-processing devices should be given notification of an operation end request according to the designation information included in the job information received by the receiver unit and the connecting orders for the plurality of post-processing devices, wherein, if a succeeding recording material is conveyed to a post-processing device to be sent the operation start request after the post-processing device to be sent the operation start request has executed conveyance of a recording material or post-processing on the recording material, the determination unit determines not to give the notification of the operation end request, and if the succeeding recording material is not conveyed to the post-processing device to be sent the operation start request, the determination unit determines to give the notification of the operation end request, and a transmitting unit configured to transmit the operation start request to each determined post-processing device such that the determined post-processing device gets into an operating state in responding to receiving the operation start request and the operation end request to each determined post-processing device such that the determined post-processing device gets into a non-operating state in responding to receiving the operation end request, wherein the at least one of the plurality of post-processing devices commences the preparatory operation in response to receiving the operation start request.

2. An image forming system comprising:

an image forming apparatus that forms an image on a recording material, and a plurality of post-processing devices that execute conveyance of a recording material and post-processing on the recording material from the image forming apparatus, at least one of the plurality of the post-processing devices requiring a preparatory operation, wherein the image forming apparatus comprises:

a storage unit configured to store connecting orders of the plurality of post-processing devices, a receiver unit configured to receive job information for a plurality of recording materials to be processed including designation information for designating a post-processing device to which each of the recording materials should be discharged, a determination unit configured to determine which of the post-processing devices should be given notification of an operation start request and determine which of the post- processing devices should be given notification of an operation end request according to the designation information included in the job information received by the receiver unit and the connecting orders for the plurality of post-processing devices, wherein, if a succeeding recording material is conveyed to a post-processing device to be sent the operation start request after the post-processing device to be sent the operation start request has executed conveyance of a recording material or post-processing on the recording material, the determination unit determines not to give the notification of the operation end request, and if the succeeding recording material is not conveyed to the post-processing device to be sent the operation start request, the determination unit determines to give the notification of the operation end request, and a transmitting unit configured to transmit the operation start request and the operation end request to each determined post-processing device, wherein each determined post-processing device gets into an operating state in response to receiving the operation start request, and gets into a non-operating state in response to receiving its operation end request, and wherein the at least one of the plurality of post-processing devices commences the preparatory operation in response to receiving the operation start request.

3. The image forming system according to claim 2, wherein the determination unit comprises:

a path determination unit configured to determine a conveying path from the image forming apparatus to the post-processing device which conveys the recording material according to the designation information and the connecting orders, and a destination target determination unit configured to determine a post-processing device present on the determined path as a post-processing device to which the operation start request is to be transmitted.

4. The image forming system according to claim 3, wherein the destination target determination unit is configured to determine a post-processing device not present on the determined conveying path as a post-processing device to which the operation end request is to be transmitted.

5. The image forming system according to claim 4, further comprising:

a control unit configured to perform control such that when there is a post-processing device not present on the determined conveying path that does not satisfy prescribed conditions for operation end dependent on a succeeding recording material, the operation end request is not transmitted to the post-processing device.

6. An image forming system, comprising:

an image forming apparatus that forms an image on a recording material, and a plurality of sheet-feeding units that feed the recording material to the image forming apparatus or transport the recording material from a preceding sheet-feeding unit, at least one of the plurality of the sheet-feeding units requiring a preparatory operation, wherein the image forming apparatus comprises:

a storage unit configured to store connecting orders of the plurality of sheet-feeding units, a receiver unit configured to receive job information for a plurality of recording materials to be fed or transported including designation information for designating a sheet-feeding unit to which each of the recording materials should be fed, a determination unit configured to determines which of the sheet-feeding units should be given notification of an operation start request and determines which of the sheet-feeding units should be given notification of an operation end request according to the designation information included in the job information received by the receiver unit and the connecting orders for the plurality of sheet-feeding units, wherein, if a sheet-feeding unit to be sent the operation start request feeds a succeeding recording material after the sheet-feeding unit to be sent the operation start request has executed conveyance of a recording material, the determination unit determines not to give the notification of the operation end request, and if a sheet-feeding unit to be sent the operation start request does not feed the succeeding recording material, the determination unit determines to give the notification of the operation end request, and a transmitting unit configured to transmit the operation start request and the operation end request to each determined sheet-feeding unit, wherein each determined sheet-feeding unit gets into an operating state in response to receiving the operation start request, and gets into a non-operating state in response to receiving the operation end request, and wherein the at least one of the sheet-feeding units commences the preparatory operation in response to receiving the operation start request.

7. A control method of an image forming apparatus to which is connected a plurality of post-processing device that executes conveyance of a recording material and post-processing on the recording material from the image forming apparatus, at least one of the plurality of the post-processing devices requiring a preparatory operation, comprising the steps of:

storing connecting orders of the plurality of post-processing devices, receiving job information for a plurality of recording materials to be processed including designation information for designating a post-process device to which each of the recording materials material should be discharged, determining which of the post-processing devices should be given notification of an operation start request and determining which of the post-processing devices should be given notification of an operation end request according to the designation information included in the received job information and the connecting orders for the plurality of post-processing devices, wherein, if a succeeding recording material is conveyed to a post-processing device to be sent the operation start request after the post-processing device to be sent the operation start request has executed conveyance of a recording material or post-processing on the recording material, the step of determining determines not to give the notification of the operation end request, and if the succeeding recording material is not conveyed to the post-processing device to be sent the operation start request, the step of determining determines to give the notification of the operation end request, and transmitting the operation start request to each determined post-processing device such that the determined post-processing device gets into an operating state in responding to receiving the operation start request and the operation end request according to the designation information to each determined post-processing device such that the determined post- processing device gets into a non-operating state in responding to receiving the operation end request.

* * * * *